US005364549A

United States Patent [19]

McDonogh

[11] Patent Number: 5,364,549

[45] Date of Patent: Nov. 15, 1994

[54] HYDROGEN PEROXIDE SOLUTIONS

[75] Inventor: Colin F. McDonogh, Widnes, England

[73] Assignee: Interox Chemicals Limited, London, England

[21] Appl. No.: 768,538

[22] PCT Filed: Sep. 20, 1990

[86] PCT No.: PCT/GB90/01450

§ 371 Date: Sep. 23, 1991

§ 102(e) Date: Sep. 23, 1991

[87] PCT Pub. No.: WO91/05079

PCT Pub. Date: Apr. 18, 1991

[30] Foreign Application Priority Data

Oct. 5, 1989 [GB] United Kingdom ..... 8922504.9

[51] Int. Cl.[5] ..... C09K 13/06; C01B 15/01; B44C 1/22

[52] U.S. Cl. ..... 252/79.4; 252/79.3; 252/186.28; 252/186.29; 156/664

[58] Field of Search ..... 252/186.28, 186.29, 252/186.30, 79.3, 79.4

[56] References Cited

U.S. PATENT DOCUMENTS

| | | | |
|---|---|---|---|
| 2,086,123 | 7/1937 | Eisenman | 8/2 |
| 3,373,113 | 3/1968 | Achenbach | 252/79.2 |
| 3,407,141 | 10/1968 | Banush et al. | 252/79.4 |
| 3,537,895 | 11/1970 | Lancy | 134/3 |
| 3,537,926 | 11/1970 | Fischer | 156/21 |
| 3,537,926 | 11/1970 | Fisher | 156/21 |
| 3,556,883 | 1/1971 | Naito et al. | 156/20 |
| 3,756,957 | 9/1973 | Shiga | 252/79.4 |
| 3,801,512 | 4/1974 | Solenberger | 252/186 |
| 3,869,401 | 3/1975 | Ernst | 252/186 |
| 4,059,678 | 11/1977 | Winkley | 423/273 |
| 4,770,808 | 9/1988 | McDonogh et al. | 252/186.29 |
| 4,875,973 | 10/1989 | Heikkila et al. | 156/664 |
| 4,900,468 | 2/1990 | Mitchell et al. | 252/95 |

FOREIGN PATENT DOCUMENTS

| | | |
|---|---|---|
| 9219945 | 8/1986 | European Pat. Off. . |
| 2216222 | 2/1973 | France . |
| 2551465 | 9/1983 | France . |

*Primary Examiner*—Robert L. Stoll
*Assistant Examiner*—Joseph D. Anthony
*Attorney, Agent, or Firm*—Larson and Taylor

[57] ABSTRACT

It would be desirable to replace nitric acid based solutions for surface treating steels and like materials with a sulphuric acid based solution containing hydrogen peroxide, but such replacement solutions lose hydrogen peroxide rapidly through mainly iron-induced decomposition.

A surface treatment solution that is based on sulphuric acid and hydrogen peroxide, but has improved stability, contains an effective amount in combination of hydrofluoric acid, are hydroxybenzoic acid and an N-alkoxyphenyl-acetamide. Preferably, the hydroxybenzoic acid is para-hydroxybenzoic acid and the N-alkoxyphenyl-acetamide is N-(4-ethoxyphenyl)-acetamide. It is preferable to employ a saturated solution of each of the two latter components, and this can achieved practically and simply by adding the solid components in the shape of a block or blocks which maintain the saturated solution over an extended period of time.

24 Claims, No Drawings

HYDROGEN PEROXIDE SOLUTIONS

The present invention relates to hydrogen peroxide solutions and more particularly to a process for its stabilisation. In a further aspect the present invention also relates to a stabiliser system for aqueous hydrogen peroxide solutions that are intended for use in metal surface treatments.

BACKGROUND OF THE INVENTION

One of the many uses for hydrogen peroxide solutions, and especially aqueous acidic hydrogen peroxide solutions, comprises the treatment of metal surfaces so as to alter their appearance and to impart chemically to the surface a desired sheen or polish. This is often referred to simply as pickling or polishing. Conventionally, solutions for that use contain one or more strong acids, which, is normally a mineral acid, as well as the hydrogen peroxide. In the course of the metal surface treatment, there is a tendency for the solution to dissolve metal or impurities from the metal surface and to strip away particulate particles that had adhered to the metal surface before the treatment commenced. The metals that are pickled or polished usually comprise or contain at least a proportion of transition metals, such as iron or copper, which catalyse the wasteful decomposition of hydrogen peroxide in aqueous solution into oxygen and water.

In view of its decomposition in situ, hydrogen peroxide often represents the major consumable cost in a pickling or polishing process. In consequence, the industry continues to seek ever more effective ways of reducing the rate and/or extent of the decomposition. In many instances, it has been sought by introducing into solution one or more substances that are often called stabilisers, which interact with the metal ions and/or metal surface and/or the hydrogen peroxide itself in such a way as to reduce the rate or extent or modify the manner of the interactions between the metal ions and hydrogen peroxide causing decomposition.

There have been many different chemical types of stabilisers proposed or employed. The literature directed to peroxide stabilisation during metal surface treatment processes includes many organic compounds as stabilisers such as a range of organic acids or unsaturated aliphatic acids in U.S. Pat. No. 3,537,895 by L. E. Lancy, aromatic alcohols or unsaturated aliphatic alcohols in U.S. Pat. No. 3,869,401 by R. E. Ernst, saturated alcohols in U.S. Pat. No. 3,556,883 by A. Naito et al, amines, amides and imines in U.S. Pat. No. 3,756,957 by S. Shiga, aryl sulphonic or sulphamic acids or related compounds in U.S. Pat. No. 3,801,512 by J. C. Solenberger et al and solid poorly soluble stabilisers like hydroxybenzoic acid in U.S. Pat. No. 4,770,808 by C. F. McDonogh et al. Many other stabilisers have been suggested for peroxide solutions including substances that chelate the metal ions or precipitate them out of solution, for example in U.S. Pat. No. 4,059,678 to D. C. Winkley. The literature also includes references to inorganic substances, such as phosphoric acid in U.S. Pat. No. 3,373,113 to Achenback. Accordingly there is a wide pool of stabilisers from which the user can select.

Despite the foregoing, the present inventors found that there remains a significant problem of stabilising hydrogen peroxide during the metal surface treatment of steel with aqueous sulphuric acid solutions of hydrogen peroxide. This is because the greater part of the literature was directed to the treatment of copper surfaces and the authors extrapolated to the treatment of other metals without adequate experimental support. To some extent, this is demonstrated in U.S. Pat. No. 3,407,141 to R. S. Banush et al, which seeks to etch copper with acidic hydrogen peroxide solutions of long storage life that contain certain urea and aromatic acid compounds. The specification suggests that the treatment can be applied to certain other metals but also that the solutions are less effective on certain other metals such as . . . stainless steel . . . . Since the patent disclosed results solely with copper, comments regarding other metals may be regarded simply as speculation.

In the course of the present research to identify, if possible, a suitable stabiliser system for acidic hydrogen peroxide solutions which are severely contaminated with dissolved iron, resulting for example from the surface treatment of steels, a large number of comparative stability trials were conducted. Each trial employed a stock solution containing 180 g/l sulphuric acid and 50 g/l hydrogen peroxide and 1% w/w "stabiliser" which was contaminated with 25 g/l dissolved iron from ferric sulphate, and stored at 30° C. or 50° C. Many of the substances tested fell within the classes of stabilisers identified in the above-mentioned patent specifications.

The trials indicated that many substances which had been described in the past as stabilisers for hydrogen peroxide in solutions containing only small amounts of catalytic ions, were unable to prevent rapid decomposition if substantial iron contamination was present, including chelating stabilisers like ethylenediaminetetraacetic acid, dipicolinic acid, nitrilotriacetic acid and ethylidene-1-hydroxy-1,1-diphosphonic acid. Moreover, it was found that some substances that acted quite well as stabilisers when employed separately, acted no better or even less well when employed in cogitation under the conditions of the trial. Other combinations of substances demonstrated strictly additive stabiliser properties. Accordingly, the trials demonstrated that a disclosure in a published patent specification that a substance had stabiliser properties towards hydrogen peroxide under much less extreme conditions or in the presence of copper as the main catalytic contaminant was no guarantee that it was capable of performing adequately in the presence of a substantial concentration of dissolved iron. The trials also demonstrated that there was no guarantee that substances that had been suggested individually as stabilisers, possibly guarding against other sources of decomposition, would combine together even additively when employed in combination.

SUMMARY OF THE INVENTION

It is an object of the present invention to locate a combination of substances which could stabilise hydrogen peroxide effectively in aqueous sulphuric acid solutions that are employed in the surface treatment of steel and therefore become contaminated with significant concentrations of iron.

According to a first aspect of the present invention there is provided a process for stabilising an aqueous solution of hydrogen peroxide containing at least 1% w/w sulphuric acid which are suitable for treating the surface of steel and like alloys characterised in that there is introduced into the solution an effective amount, in combination of hydrofluoric acid, hydroxybenzoic acid and an N-alkoxyphenyl-acetamide.

According to a related aspect, there is provided a stabilised aqueous solution of hydrogen peroxide containing at least 1% w/w sulphuric acid and an effective amount in combination of hydrofluoric acid, hydroxybenzoic acid and an N-alkoxyphenyl-acetamide.

According to a further and related aspect of the present invention there is provided a process for the surface treatment of steel or a like alloy in which the latter is contacted with an aqueous solution of hydrogen peroxide containing at least 1% w/w sulphuric acid characterised in that it contains an effective amount in combination of hydrofluoric acid, hydroxybenzoic acid and an N-(alkoxyphenyl)-acetamide.

In the context of the present invention, the stabiliser combination comprises hydrofluoric acid, an aromatic acid and an aromatic amide. The hydroxybenzoic acid is particularly preferably p-hydroxybenzoic acid and the N-(alkanoxyphenyl)-acetamide, advantageously, contains a low molecular weight alkanoxy substituent and especially the compound is N-(4-ethoxy-phenyl)-acetamide.

DESCRIPTION OF PREFERRED EMBODIMENTS

Without being bound to any particular theory, the inventors believe that the components of the stabiliser system form a range of fluoride-containing complexes with iron and other ions that pass into solution during surface treatment of steels. The properties of these complexes, and in particular their interaction with hydrogen peroxide are believed to dictate the stability and hence extent of decomposition losses of hydrogen peroxide during the surface treatments. Furthermore, the presence of hydrofluoric acid is believed to provide the potential for the iron complexes to be significantly different from corresponding complexes in the absence of hydrofluoric acid and that this may explain to at least some extent why it is so difficult to apply teachings given for other solutions in the prior art and teachings on individual components in respect of the combination of the present invention.

The solution preferably contains from 0.5 to 10% w/w hydrofluoric acid and advantageously from 1 to 6%.

The concentrations of the aromatic acid and the aromatic amide in solution are each preferably at least 0.5 g/l and most preferably at or near saturation. Since they tend to be relatively poorly soluble, saturation can be attained by introduction of about 1 g/l up to a few g/l of each. The weight ratio of the hydroxy benzoic acid to the acetamide is preferably in the range of 25:1 to 1:5.

In one preferred method of employing the invention stabiliser combination, advantage is taken of the physical properties of the two aromatic components, namely the acid and amide. In the preferred method, these two components are selected on the bases of their melting point and solubility. Specifically, it is preferable to select an acid and an amide which does not melt until a temperature significantly in excess of about 70° C. is attained and which are scarcely soluble in an aqueous acidic medium. Such compounds will naturally be solids in the normal range of operating temperatures for hydrogen peroxide-based steel surface treatments and can dissolve to form a dilute, but saturated solution. It is especially desirable to incorporate an excess amount of the aromatic acid and amide beyond that needed for a saturated solution so as to provide within the treatment bath a solid phase, a reservoir which can replenish the saturated solution as the compound is removed by the normal operation of the metal surface treatments, including in situ oxidation and by adhesion to the surface of the workpiece on separation from the bath. It will be recognised that both the above-named aromatic acid and aromatic amide demonstrate both such preferred characteristics, thereby rendering them especially attractive for this preferred method.

Whilst it is conceivable to incorporate such solids in the metal surface treatment solution in powder or granular form, there is a distinct tendency for that form of solids to be lost by carry out from a surface treatment bath. Powders are not easy to observe, so that it can be difficult to know how much of the solids are still present and in the extreme case whether any is present at all. Accordingly, in a more preferred mode of operation, the two solid poorly soluble components of the stabiliser system are each employed in the form of a block containing either an individual component or a mixture of them. The block is much easier to detect than is the corresponding amount of powder or flakes, either visually or by a non-manual system. Accordingly, regulation of the solid stabilisers in the treatment bath can be accomplished without recourse to elaborate and expensive monitoring equipment, whilst still minimising the possibility that the bath would be left without the organic components of the stabiliser system.

The term "block" is used in its normal dictionary meaning, as in U.S. Pat. No. 4,770,808, and covers a wide range of sizes. It typically has a weight of at least 30 g and up to a few kg weight, e.g. 10 kg. For many practical purposes, it weighs initially from 200 g to 5 kg, but will slowly be consumed during operation of the bath.

The block is normally obtained by compression or binding of flakes, granules or powders into a tablet shape or in some other mould shape such as cube, cuboid polyhedron or cylinder, or by resolidification of a melt in such a mould or by extrusion of a rod or bar. Such techniques are well known in the field of tablet or block formation and accordingly need not be described in further detail herein.

The hydrogen peroxide solution is often described as a dilute solution. It normally contains at least 1% w/w hydrogen peroxide and it is unusual for it to contain more than 10% w/w. For the treatment of steels, it is often convenient to select within the range of from 3 to 8% w/w hydrogen peroxide. During normal operation, peroxide is consumed, so that without corrective means, its concentration would gradually diminish. At the discretion of the user, he can seek to maintain a steady state by introducing peroxide gradually at a rate that matches its consumption, including decomposition, or he can permit the concentration to fluctuate by augmenting the peroxide concentration periodically. The metal treatment solution is most conveniently obtained by the dilution of a concentrated commercial hydrogen peroxide solution, typically containing from 35 to 70% w/w hydrogen peroxide and trace amounts, i.e. below about 0.1% of known storage stabilisers such as pyrophosphate and/or stannate and/or polyphosphonic acid compounds.

The sulphuric acid concentration in the solution is normally not higher than 20% v/v and in many instances is conveniently selected in the region of 5 to 15% v/v.

The solution can also include minor amounts of the customary additives in metal treatment solutions, such as up to about 2% w/w wetting agents.

The processes using the stabilised hydrogen peroxide solutions of the present invention are normally carried out at a bath temperature of above ambient, and in many instances in the range of from 40° C. to 70° C. Higher temperatures of up to about 80° C. are less often encountered, but become more attractive as a result of the stabilisation of the hydrogen peroxide component in the bath.

The residence period for the work-piece in the treatment bath is at the discretion of the user and naturally depends on the finish that it is desired to achieve. Residence periods are often selected in the range of from 30 seconds to 30 minutes, and normally from 1 to 5 minutes.

The stabilised acidic hydrogen peroxide solutions are primarily intended for the pickling or polishing of steels, including mild steel and is of especial value for treating stainless steels. Steels suitable for treatment by the invention process and compositions can contain minor proportions of such metals as chromium, nickle, and manganese; i.e. the metals that are incorporated in corrosion-resistant or stainless steels.

It will be recognised that the process and compositions according to the present invention can be employed instead of nitric acid-containing metal treatment compositions, thereby avoiding the problems of NOx emissions that accompany the use of nitric acid.

Having described the invention in general terms, specific embodiments thereof will now be described in more detail by way of example only.

EXAMPLE 1 AND COMPARISONS CA TO CC

In this example and these comparisons, the effectiveness of the invention combination of stabiliser components is compared under the same conditions of high dissolved iron with stabiliser-free pickling solution and solution containing components of the combination. In each trial, a solution was prepared which contained 5% w/w hydrogen peroxide, 10% v/v sulphuric acid, and 1.8% w/w ferric iron, added as ferric sulphate and the stabiliser(s) listed in Table 1 below were then mixed into the solution. The solid stabilisers are referred to by their abbreviations; PHBA for p-hydroxybenzoic acid and NEPA for N-(4-ethoxy-phenyl)acetamide. Although the hydrofluoric acid was entirely miscible with the solution, the solid stabilisers did not dissolve completely, forming a saturated solution of the two compounds and leaving a residue of solid material.

The solutions were then kept at 30° C. and the residual hydrogen peroxide content was measured at intervals by the standard potassium permanganate method. Table 1 below indicates the half life of the hydrogen peroxide in the solution, by which herein we mean the time taken for the measured hydrogen peroxide to fall to half its initial concentration.

TABLE 1

| Example | Stabiliser System g/l | | | Half-life of $H_2O_2$ |
|---|---|---|---|---|
| Comp No | HF | PHBA | NEPA | hours |
| CA | — | — | — | 2 |
| CB | 40 | — | — | 3 |
| CC | — | 5 | 5 | 8 |
| Ex1 | 40 | 5 | 5 | >300 |

From Table 1, it can be seen that the effect of employing either the HF alone or the solids alone resulted in some improvement in peroxide stability, but their use in combination resulted in a very substantial improvement, well mn excess of a simple additive effect. This shows that the combination is particularly effective in the presence of substantial concentrations of iron in solution, as would arise from the surface treatment of steel and like alloys.

EXAMPLES 2 TO 5

In these examples, Example 1 was repeated, but using respectively a total weight of PHBA and NEPA (wt ratio 1:1) of 5 g/l, 10 g/l, 15 g/l and 20 g/l, HF at 40 g/l, 12.5% by volume sulphuric acid (98% w/w), about 50 g/l hydrogen peroxide and 29 g/l iron introduced as ferric sulphate. Within the limits of experimental variation, all four amounts of stabilisers resulted in a similar and high proportion of hydrogen peroxide being retained, viz about 82% after 43 hours. This is consistent with PHBA and NEPA forming saturated solutions at all four stabiliser amounts tested. To the extent that any trend was apparent, the most efficatious amount was the smallest.

EXAMPLES 6 TO 11

In these examples, a solution was prepared which contained 5% w/w hydrogen peroxide, 10% v/v sulphuric acid, 1.8% w/w ferric iron, added as ferric sulphate and 10 g/l of a mixture of PHBA and NEPA in the proportions by weight listed in Table 2. The solutions were stored at 50° C. in order to obtain the comparative results quickly, and residual hydrogen peroxide contents measured at intervals, as for Example 1. Table 2 indicates the percentage remaining after 24 hours.

TABLE 2

| Ex No | Ratio of NEPA:PHBA | % peroxide remaining |
|---|---|---|
| 6 | 2.3:1 | 46 |
| 7 | 1:1 | 42 |
| 8 | 1:4 | 53 |
| 9 | 1:9 | 43 |
| 10 | 1:24 | 45 |
| 11 | 9:1 | 32 |

From Table 2, it can be seen that the combination of HF plus NEPA plus PHBA remained a very effective stabiliser over a wide range of ratios of NEPA to PHBA, and especially in Examples 6 to 10 in which the amount of each of the two solid components was sufficient to ensure a saturated solution of each.

EXAMPLE 12

In this example, Example 7 was repeated but employing a solution containing additionally chromium at a concentration of 5 g/l, introduced as chromic sulphate. Within the limits of experimental variations, the proportion of hydrogen peroxide remaining in solution after 24 hours storage at 50° C. was the same as in the absence of the chromium. This demonstrates that the stabiliser system is applicable for use in the surface treatment of stainless steels. In other comparative tests carried out with varying additions of chromium to an iron contaminated sulphuric acid/peroxide solution containing the invention stabiliser system, there was a tendency for the stabilisation to become somewhat impaired as the concentration of chromium was increased from 5 to 20 g/l.

I claim:

1. In a method of treating a surface of steel and like alloys which comprises contacting said surface with a stabilized aqueous acidic hydrogen peroxide solution to alter the appearance of the surface and to impart thereto a sheen or polish, said solution containing hydrogen peroxide, sulfuric acid, and a stabilizer for reducing decomposition of the hydrogen peroxide, the improvement wherein the stabilizer comprises hydrofluoric acid, hydroxybenzoic acid and an N-alkoxyphenyl-acetamide, the amount of each of the hydrofluoric acid, the hydroxybenzoic acid and the N-alkoxyphenyl-acetamide being such that said stabilizer is effective to reduce decomposition of the hydrogen peroxide to an extent which is greater than the simple additive effect of the hydrofluoric acid, the hydroxybenzoic acid and the N-alkoxyphenyl-acetamide.

2. A method according to claim 1 wherein the hydrogen peroxide concentration is not more than 10% by weight.

3. A method according to claim 2 wherein the hydrogen peroxide concentration is from 1–10% by weight.

4. A method according to claim 2 wherein the sulfuric acid is present in an amount of from 1 to 20% v/v.

5. A method according to claim 2 wherein the hydrofluoric acid is present in an amount of 0.5 to 10% w/w.

6. A method according to claim 5 wherein the hydrofluoric acid concentration is from 1–6% w/w.

7. A method according to claim 2 wherein the hydroxybenzoic acid and the N-alkoxyphenyl-acetamide are each present in an amount of up to a saturated solution.

8. A method according to claim 2 wherein said hydroxybenzoic acid comprises p-hydroxybenzoic acid.

9. A method according to claim 8 wherein the N-alkoxyphenyl-acetamide comprises N-(4-ethoxyphenyl)-acetamide.

10. In a stabilized aqueous acidic hydrogen peroxide composition suitable for use in metal surface treatment and containing hydrogen peroxide, sulfuric acid, and a stabilizer for reducing decomposition of the hydrogen peroxide, the improvement wherein the stabilizer comprises hydrofluoric acid, hydroxybenzoic acid and an N-alkoxyphenyl-acetamide, the amount of each of the hydrofluoric acid, the hydroxybenzoic acid and the N-alkoxyphenyl-acetamide being such that said stabilizer is effective to reduce decomposition of the hydrogen peroxide to an extent which is greater than the simple additive effect of the hydrofluoric acid, the hydroxybenzoic acid and the N-alkoxyphenyl-acetamide.

11. A composition according to claim 10 wherein the hydrogen peroxide concentration is not more than 10% by weight.

12. A composition according to claim 11 wherein the hydrogen peroxide concentration is from 1–10% by weight.

13. A composition according to claim 11 wherein the sulfuric acid is present in an amount of from 1 to 20% v/v.

14. A composition according to claim 11 wherein the hydroxybenzoic acid and the N-alkoxyphenyl-acetamide are each present in an amount of up to a saturated solution.

15. A composition according to claim 11 wherein the hydroxybenzoic acid comprises p-hydroxybenzoic acid.

16. A composition according to claim 11 wherein the N-alkoxyphenyl-acetamide comprises N-(4-ethoxyphenyl)-acetamide.

17. A composition according to claim 11 wherein the weight ratio of the hydroxybenzoic acid to the N-alkoxyphenyl-acetamide is from 5:1 to 25:1.

18. A composition according to claim 11 wherein the hydroxybenzoic acid and the N-alkoxyphenyl-acetamide are present in the form of a block or blocks.

19. A composition according to claim 11 wherein the hydrofluoric acid is present in an amount of 0.5 to 10% w/w.

20. A composition according to claim 19 wherein the hydrofluoric acid concentration is from 1–6% w/w.

21. A stabilizer composition for stabilizing an aqueous acidic hydrogen peroxide solution suitable for metal surface treatment and containing hydrogen peroxide and sulfuric acid, said stabilizer composition comprising hydrofluoric acid, hydroxybenzoic acid and N-alkoxyphenyl-acetamide, said stabilizer composition being capable, when added to said acidic hydrogen peroxide solution, of reducing the decomposition of said hydrogen peroxide to an extent which is greater than the simple additive effect of the hydrofluoric acid, the hydroxybenzoic acid, and the N-alkoxyphenyl-acetamide.

22. A composition according to claim 21 wherein the weight ratio of the hydroxybenzoic acid to the N-alkoxyphenyl-acetamide is from 1:5 to 25:1.

23. A composition according to claim 22 wherein said hydroxybenzoic acid comprises para-hydroxybenzoic acid.

24. A composition according to claim 23 wherein said N-alkoxyphenyl-acetamide comprises N-(4-alkoxyphenyl)-acetamide.

* * * * *